US009885467B2

(12) United States Patent
Nicieja et al.

(10) Patent No.: US 9,885,467 B2
(45) Date of Patent: Feb. 6, 2018

(54) LOW VOLTAGE POWER SUPPLY FOR A MERCHANDISE DISPLAY SYSTEM

(71) Applicant: RTC Industries, Inc., Rolling Meadows, IL (US)

(72) Inventors: Robert Nicieja, Carol Stream, IL (US); Thomas E. Hubley, Fox River Grove, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 15/164,174

(22) Filed: May 25, 2016

(65) Prior Publication Data

US 2017/0033522 A1 Feb. 2, 2017

Related U.S. Application Data

(63) Continuation of application No. 14/254,873, filed on Apr. 16, 2014, now Pat. No. 9,360,196, which is a (Continued)

(51) Int. Cl.
*F21V 21/35* (2006.01)
*A47F 3/00* (2006.01)

(Continued)

(52) U.S. Cl.
CPC ..... *F21V 21/35* (2013.01); *A47F 3/001* (2013.01); *H01R 13/6205* (2013.01);

(Continued)

(58) Field of Classification Search
CPC .... H01R 9/2408; H01R 12/716; H01R 13/02; H01R 13/20; H01R 13/22; H01R 13/2407;

(Continued)

(56) References Cited

U.S. PATENT DOCUMENTS 3,622,938 A 11/1971 Ito et al.
4,414,617 A 11/1983 Galindo (Continued)

FOREIGN PATENT DOCUMENTS

CA 2178502 A1 6/1995
CA 2173799 A1 10/1997

(Continued)

OTHER PUBLICATIONS

Aug. 13, 2014—(WO) ISR and Written Opinion—App. No. PCT/US2014/043831.

(Continued)

*Primary Examiner* — Truc Nguyen
(74) *Attorney, Agent, or Firm* — Banner & Witcoff, Ltd.

(57) ABSTRACT

A merchandise display system may include a low voltage power assembly may comprise a track that includes one or more conductive rods and one or more mechanical connections, wherein the track is powered from a power source; and a power connector assembly that connects to the track, wherein the one or more conductive rods connect to the power assembly providing a power connection, and further wherein the one or more mechanical connections connect to the power assembly providing a mechanical connection. The power connector assembly may be configured to provide low voltage power through the track to a low voltage power device. The power assembly may include a configuration of mechanical connections and conductive material arranged in such a way as to provide power and/or signal distribution to a mating device, such as to a set of LED modules, other lighting sources, or powered track devices for use with a merchandise display system.

18 Claims, 18 Drawing Sheets

Related U.S. Application Data continuation-in-part of application No. 13/924,948, filed on Jun. 24, 2013, now Pat. No. 9,146,029, which is a continuation-in-part of application No. 13/918,281, filed on Jun. 14, 2013, now Pat. No. 9,225,131.

(60) Provisional application No. 61/660,060, filed on Jun. 15, 2012.

(51) Int. Cl.

| | |
|---|---|
| ***H01R 13/62*** | (2006.01) |
| ***H01R 25/14*** | (2006.01) |
| *H01R 13/627* | (2006.01) |
| *F21W 131/405* | (2006.01) |
| *F21Y 115/10* | (2016.01) |

(52) U.S. Cl.
CPC ..... *H01R 25/147* (2013.01); *F21W 2131/405* (2013.01); *F21Y 2115/10* (2016.08); *H01R 13/6271* (2013.01)

(58) Field of Classification Search
CPC .... H01R 2201/12; H01R 25/14; H01R 12/61; H01R 12/714; H01R 13/24; H01R 13/5224; H01R 13/6205; H01R 13/6464
See application file for complete search history.

(56) References Cited

U.S. PATENT DOCUMENTS

| | | | | |
|---|---|---|---|---|
| 4,825,540 | A * | 5/1989 | Kelly | H01R 25/14 29/857 |
| 4,861,273 | A | 8/1989 | Wenman et al. | |
| 4,875,871 | A | 10/1989 | Booty, Sr. et al. | |
| 5,025,355 | A | 6/1991 | Harwood | |
| 5,154,509 | A | 10/1992 | Wulfman et al. | |
| 5,168,173 | A | 12/1992 | Windsor | |
| 5,205,638 | A | 4/1993 | Squitieri | |
| 5,319,250 | A | 6/1994 | Windsor | |
| 5,366,100 | A | 11/1994 | Maglione | |
| 5,545,958 | A | 8/1996 | Kramer | |
| 5,551,577 | A | 9/1996 | Hagopian | |
| 5,588,537 | A | 12/1996 | Hagopian | |
| 5,673,985 | A | 10/1997 | Mitchell | |
| 5,695,261 | A | 12/1997 | Slesinger et al. | |
| 5,746,332 | A | 5/1998 | Kleinschmidt | |
| 5,758,585 | A | 6/1998 | Latchinian | |
| 5,785,411 | A | 7/1998 | Komai et al. | |
| 5,794,794 | A | 8/1998 | Hull | |
| 5,810,457 | A | 9/1998 | Felsenthal et al. | |
| 5,811,892 | A | 9/1998 | Battles et al. | |
| 5,829,864 | A | 11/1998 | Scanlan | |
| 5,921,190 | A | 7/1999 | Wood | |
| 6,021,908 | A | 2/2000 | Mathews | |
| 6,033,097 | A | 3/2000 | Harwood | |
| 6,113,198 | A | 9/2000 | Hommes | |
| 6,135,583 | A | 10/2000 | Simon et al. | |
| 6,138,583 | A | 10/2000 | Mahone et al. | |
| 6,204,632 | B1 | 3/2001 | Nierescher et al. | |
| 6,231,205 | B1 | 5/2001 | Slesinger et al. | |
| 6,302,282 | B1 | 10/2001 | Gay et al. | |
| 6,364,273 | B1 | 4/2002 | Otema | |
| 6,406,108 | B1 | 6/2002 | Lipton et al. | |
| 6,460,470 | B1 | 10/2002 | Scharer et al. | |
| 6,478,444 | B2 | 11/2002 | Schaerer et al. | |
| 6,527,406 | B1 | 3/2003 | Slesinger et al. | |
| 6,543,688 | B1 | 4/2003 | Massaro | |
| 6,550,673 | B2 | 4/2003 | Massaro | |
| 6,619,814 | B1 | 9/2003 | Hamada et al. | |
| 6,669,029 | B1 | 12/2003 | Beane | |
| 6,742,907 | B2 | 6/2004 | Funamoto et al. | |
| 6,749,116 | B2 | 6/2004 | Massaro | |
| 6,796,248 | B1 | 9/2004 | Dressendorfer et al. | |
| 6,895,705 | B2 | 5/2005 | Hillstrom et al. | |
| 6,902,308 | B2 | 6/2005 | Love | |
| 6,932,446 | B2 | 8/2005 | Hales | |
| 7,025,217 | B2 | 4/2006 | Crown et al. | |
| 7,040,494 | B2 | 5/2006 | Harper | |
| 7,121,675 | B2 | 10/2006 | Ter-Hovhannisian | |
| 7,137,727 | B2 | 11/2006 | Joseph et al. | |
| 7,172,332 | B2 | 2/2007 | Mobarak et al. | |
| 7,173,821 | B2 | 2/2007 | Coglitore | |
| 7,175,034 | B2 | 2/2007 | Nook et al. | |
| 7,201,487 | B2 | 4/2007 | Pinter | |
| 7,201,488 | B2 | 4/2007 | Sakamoto et al. | |
| 7,367,685 | B2 | 5/2008 | Moll | |
| 7,453,419 | B2 | 11/2008 | Yee et al. | |
| 7,513,675 | B2 * | 4/2009 | Mier-Langner | F21S 8/038 362/147 |
| 7,537,374 | B2 | 5/2009 | Schardt et al. | |
| 7,597,462 | B2 | 10/2009 | Misof | |
| 7,614,350 | B2 | 11/2009 | Tuttle et al. | |
| 7,665,860 | B2 | 2/2010 | Demarest et al. | |
| 7,743,933 | B2 | 6/2010 | Martin et al. | |
| 7,784,885 | B2 | 8/2010 | Steiger et al. | |
| 7,806,268 | B2 | 10/2010 | Angelocci | |
| 7,806,543 | B2 | 10/2010 | Swofford et al. | |
| 7,832,874 | B2 | 11/2010 | Ikeda et al. | |
| 7,832,888 | B2 | 11/2010 | Demarest et al. | |
| 7,840,286 | B2 | 11/2010 | Caldwell et al. | |
| 7,857,214 | B2 | 12/2010 | Saliaris | |
| 7,909,499 | B2 | 3/2011 | Snagel et al. | |
| 7,954,958 | B2 | 6/2011 | Ikeda et al. | |
| 7,997,430 | B2 | 8/2011 | Clark et al. | |
| 8,021,009 | B2 | 9/2011 | Knoll et al. | |
| 8,047,657 | B2 | 11/2011 | Ikeda et al. | |
| 8,123,052 | B2 | 2/2012 | Clark et al. | |
| 8,128,272 | B2 | 3/2012 | Fine et al. | |
| 8,135,482 | B2 | 3/2012 | Caldwell et al. | |
| 8,651,711 | B2 | 2/2014 | Rudisill et al. | |
| 2002/0064979 | A1 * | 5/2002 | Zakerzewski | F21S 8/06 439/110 |
| 2003/0179578 | A1 | 9/2003 | Albert et al. | |
| 2003/0223232 | A1 | 12/2003 | Belfer et al. | |
| 2008/0155915 | A1 | 7/2008 | Howe et al. | |
| 2009/0244925 | A1 | 10/2009 | Snagel et al. | |
| 2009/0279298 | A1 | 11/2009 | Mier-Langner et al. | |
| 2010/0290215 | A1 * | 11/2010 | Metcalf | A47B 21/00 362/127 |
| 2010/0321929 | A1 | 12/2010 | Ramirez et al. | |
| 2011/0136353 | A1 | 6/2011 | Spitaels et al. | |
| 2011/0204009 | A1 | 8/2011 | Karan | |
| 2011/0273867 | A1 | 11/2011 | Horst et al. | |
| 2013/0044501 | A1 | 2/2013 | Rudisill et al. | |
| 2013/0207478 | A1 * | 8/2013 | Metcalf | A47C 7/70 307/104 |

FOREIGN PATENT DOCUMENTS

| | | | |
|---|---|---|---|
| CA | 2250945 | A1 | 10/1997 |
| CA | 2393427 | A1 | 6/2001 |
| CA | 2467585 | A1 | 5/2003 |
| CA | 2471190 | A1 | 12/2004 |
| CA | 2443755 | A1 | 4/2005 |
| CA | 2485670 | A1 | 4/2005 |
| CA | 2554834 | A1 | 8/2005 |
| CA | 2525992 | A1 | 5/2006 |
| CA | 2501809 | A1 | 9/2006 |
| CA | 2558608 | A1 | 2/2008 |
| CA | 2568612 | A1 | 4/2008 |
| CA | 2671794 | A1 | 6/2008 |
| CA | 2653264 | A1 | 8/2009 |
| CA | 2706720 | A1 | 9/2009 |
| CA | 2681996 | A1 | 4/2010 |
| CA | 2752749 | A1 | 11/2011 |
| DE | 202010003919 | U1 | 7/2010 |
| EP | 1286612 | A1 | 3/2003 |
| EP | 1830680 | A1 | 9/2007 |
| EP | 1839539 | A2 | 10/2007 |
| FR | 2850550 | A1 | 8/2004 |
| FR | 2852502 | A1 | 9/2004 |
| FR | 2859889 | A1 | 3/2005 |

(56) References Cited

FOREIGN PATENT DOCUMENTS

| | | | |
|---|---|---|---|
| FR | 2860133 | A1 | 4/2005 |
| FR | 2869779 | A1 | 11/2005 |
| FR | 2881331 | A1 | 8/2006 |
| FR | 2891716 | A1 | 4/2007 |
| FR | 2923578 | A1 | 5/2009 |
| FR | 2940031 | A1 | 6/2010 |
| FR | 2946852 | A1 | 12/2010 |
| FR | 2950412 | A1 | 3/2011 |
| FR | 2955193 | A1 | 7/2011 |
| FR | 2960395 | A1 | 12/2011 |
| GB | 2297896 | A | 8/1996 |
| GB | 2325148 | A | 11/1998 |
| KR | 1994-0002346 | | 4/1994 |
| KR | 20070106298 | A | 11/2007 |
| WO | 1993018499 | A1 | 9/1993 |
| WO | 1996003902 | A1 | 2/1996 |
| WO | 1997005809 | A1 | 2/1997 |
| WO | 9738610 | A1 | 10/1997 |
| WO | 1997038610 | A1 | 10/1997 |
| WO | 9851963 | A2 | 11/1998 |
| WO | 199851963 | A2 | 11/1998 |
| WO | 2000024297 | A1 | 5/2000 |
| WO | 2000075561 | A1 | 12/2000 |
| WO | 2001000065 | A1 | 1/2001 |
| WO | 2001043598 | A1 | 6/2001 |
| WO | 2001045537 | A1 | 6/2001 |
| WO | 2001093728 | A1 | 12/2001 |
| WO | 03070060 | A1 | 8/2003 |
| WO | 2003063655 | A1 | 8/2003 |
| WO | 2004102354 | A2 | 11/2004 |
| WO | 2005074635 | A2 | 8/2005 |
| WO | 2006067396 | A1 | 6/2006 |
| WO | 2006086998 | A1 | 8/2006 |
| WO | 2007016515 | A1 | 2/2007 |
| WO | 2008073829 | A2 | 6/2008 |
| WO | 2008133712 | A1 | 11/2008 |
| WO | 2010005093 | A1 | 1/2010 |
| WO | 2011046593 | A2 | 4/2011 |
| WO | 2011115685 | A1 | 9/2011 |

OTHER PUBLICATIONS

Jul. 13, 2016 (AU) First Examination Report—App 2014302709.

Dec. 29, 2015—(WO) IPRP and Written Opinion—App. No. PCT/US2014/043831.

Oct. 22, 2015—(WO) ISR and Written Opinion—App. No. PCT/US2015/026208.

Aug. 18, 2017—(EP) Office Action—App. No. 15722606.9.

* cited by examiner

LOW VOLTAGE POWER SUPPLY FOR A MERCHANDISE DISPLAY SYSTEM

CROSS REFERENCE TO RELATED APPLICATIONS

This Application is a continuation of U.S. application Ser. No. 14/254,873, filed Apr. 16, 2014, which is a continuation-in-part to U.S. application Ser. No. 13/924,948, filed Jun. 24, 2013, issued as U.S. Pat. No. 9,146,029 on Sep. 29, 2015, which is a continuation-in-part application to U.S. application Ser. No. 13/918,281, filed Jun. 14, 2013, issued as U.S. Pat. No. 9,225,131 on Dec. 29, 2015, which claims priority to U.S. Provisional Application No. 61/660,060, filed Jun. 15, 2012. These above-identified U.S. applications are herein incorporated by reference in their entirety.

FIELD OF INVENTION

This invention relates generally to power systems. In particular, in one aspect of the invention, a low voltage power supply with magnetic connections or mechanical connections is provided.

BACKGROUND

In many exemplary power/signal systems, there is a problem with providing power to many devices while trying to create good wire management. Additionally, there is a problem with providing power to many devices while creating a dynamic or flexible system that allows for device relocation, addition of devices, and removal of devices for the power/signal systems. Existing solutions provide cable raceways with multiple connection points (outlet strip approach) or power track systems (track lighting approach). Although many conductors for power and signal combinations can be used, the "outlet strip approach" lacks flexibility and expandability for adding or relocating devices. Traditional powered track systems lack easy ways to incorporate many power and signal conductors. Additionally for each conductor added to the traditional power track systems the connector required to access those conductors grows significantly in complexity and size.

In one exemplary aspect of the present invention, a low voltage power system may include a configuration of ferrous material, conductive material, and nonconductive materials arranged in such a way as to provide a method for power and/or signal distribution to a mating device, such as to a set of magnetic LED modules or other similar low voltage power devices. Generally, low voltage power systems and low voltage power devices have a voltage of approximately 24 volts or less.

In another exemplary aspect of the present invention, a power system may include a configuration of conductive material and mechanical connections arranged in such a way as to provide a method for power and/or signal distribution to a mating device, such as to a set of mechanically-connected low voltage power devices.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In one exemplary embodiment, a low voltage power assembly may comprise: (a) a track that includes a first end and a second end opposite the first end, wherein the track is powered from a low voltage power source; and (b) a power connector assembly that connects to the track both through a mechanical connection and a low voltage power connection. The power connector assembly may be configured to provide low voltage power through the track to a low voltage power device. The track may include one or more conductive plates that connect to the power connector assembly providing the low voltage power connection. Additionally, the track may include one or more mechanical connection plates that connect to the power connector assembly providing the mechanical connection. The low voltage power device may be, for example, an LED lighting system for a merchandise display system.

In another exemplary embodiment, a power assembly may comprise: (a) a track that includes one or more mechanical connection plates and one or more conductive plates adjacent to one another, wherein the track is powered from a power source; and (b) a printed circuit board that connects to the track both through a mechanical connection and a low voltage power connection. The printed circuit board may be configured to provide power through the track to a power device. The printed circuit board may include one or more contacts that connect to the one or more conductive plates on the track providing the power connection. Additionally, the printed circuit board may include one or more mechanical connectors that connect to the one or more mechanical connection plates on the track providing the mechanical connection. The power device may be, for example, an LED lighting system for a merchandise display system.

In another exemplary embodiment, a low voltage power assembly may comprise: 1) a track that includes one or more conductive plates, one or more mechanical plates, and one or more metal plates, wherein the track is powered from a low voltage power source; 2) a first power connector assembly that connects to the track, wherein the one or more conductive plates connect to the first power assembly providing a low voltage power connection, and further wherein the one or more metal plates connect to the first power assembly providing a magnetic connection; and 3) a second power connector assembly that connects to the track, wherein the one or more conductive plates connect to the second power assembly providing a low voltage power connection, and further wherein the one or more mechanical connection plates connect to the second power assembly providing a mechanical connection. The first and the second power connector assemblies may be configured to provide low voltage power through the track to a low voltage power device.

In another exemplary embodiment, a merchandise display system may comprise: 1) a track that includes a first end and a second end opposite the first end, wherein the track is powered from a low voltage power source; and 2) a tray assembly configured for displaying products and connecting to the merchandise display system, the tray assembly including a power connector assembly that connects to the track both through a mechanical connection and a low voltage power connection. The power connector assembly may be configured to provide low voltage power through the track to a low voltage power device.

In another exemplary embodiment, a merchandise display system may include: a track that includes one or more conductive rods adjacent to one another, wherein the track is powered from a power source and the track is configured to connect to the merchandise display system; a tray assembly configured to display products and connect to the merchandise display system. The tray assembly may include: a power connector that connects to the track both through a mechanical connection and a power connection, wherein the power connector includes a contact, a wire harness, a power jack; and a printed circuit board that connects to the power jack of the power connector. The printed circuit board may be configured to provide power to a power device. The low voltage power device may be a LED lighting system configured to illuminate the merchandise display system.

Other objects and features of the invention will become apparent by reference to the following description and drawings.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized, and structural and functional modifications may be made without departing from the scope of the present invention. Also, while the terms "top" and "bottom" and the like may be used in this specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention.

These embodiments illustrate a low voltage power supply with magnetic connections. These systems allow for an easy method of distributing both power and other signals without the need for complex wiring and secondary wire management. Additionally, the attachment of devices to the track system is magnetic. Uses for the invention include but are not limited to retail environments that may require periodic/regular relocation of devices connected to the distribution track. These embodiments are intended to distribute both power while allowing the easy movement and placement of connected devices such as lighting systems for the retail merchandise display systems.

An embodiment of an exemplary low voltage power system is illustrated in FIGS. 1 through 7. Generally, the low voltage power system may be utilized as a distribution track with a magnetic power connector connected both magnetically and for power to the distribution track. In one exemplary embodiment, a lighting assembly or lighting bar with one or more magnetic connector lighting systems, such as LEDs or other types of lights. The exemplary low power voltage system may include a configuration or assembly of ferrous material, conductive material, and nonconductive materials arranged in such a way as to provide a method for power and/or signal distribution to a mating device. The mating device may include a set of magnetic LED modules. The mating device may include magnetic materials, such as magnets or magnetic coils, conductive materials, nonconductive materials, and electronics. The conductive materials may be for example spring contacts. The electronics may utilize the distributed power and/or signals.

Figure 1:
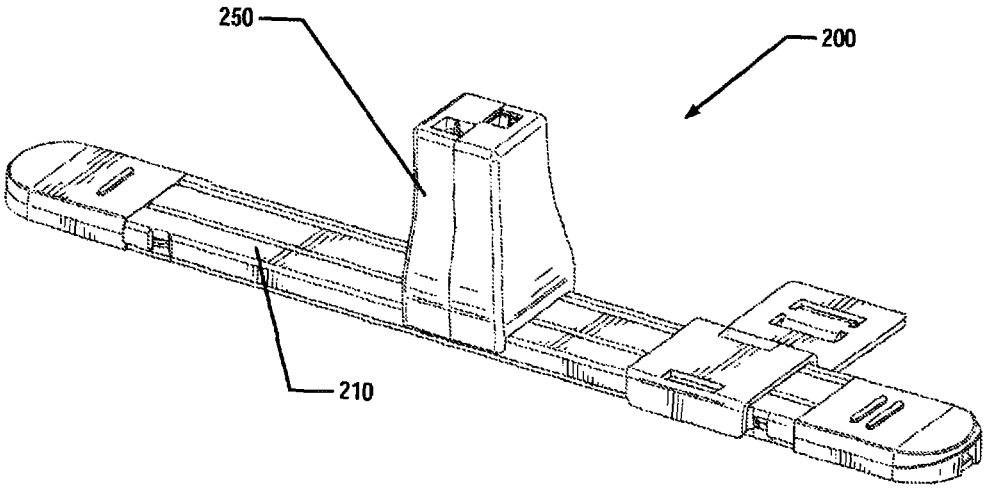
FIG. 1 shows a perspective view of an exemplary lighting assembly that includes a track and connector assembly.
Figure 2:
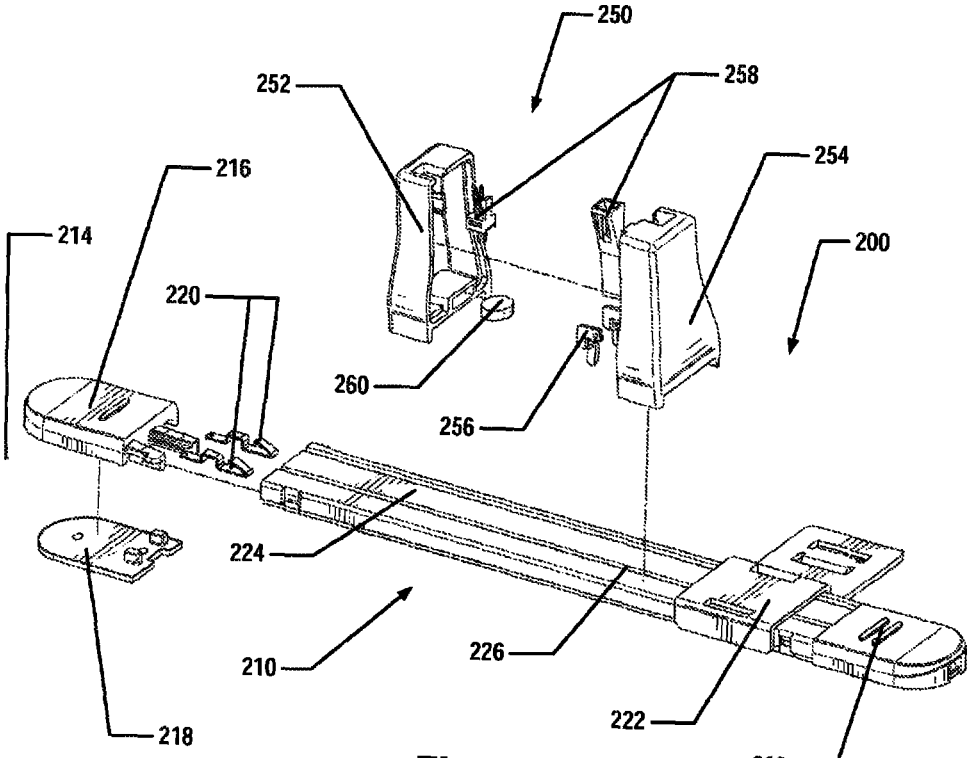
FIG. 2 shows an exploded perspective view of the track and connector assembly from FIG. 1.
Figure 3:
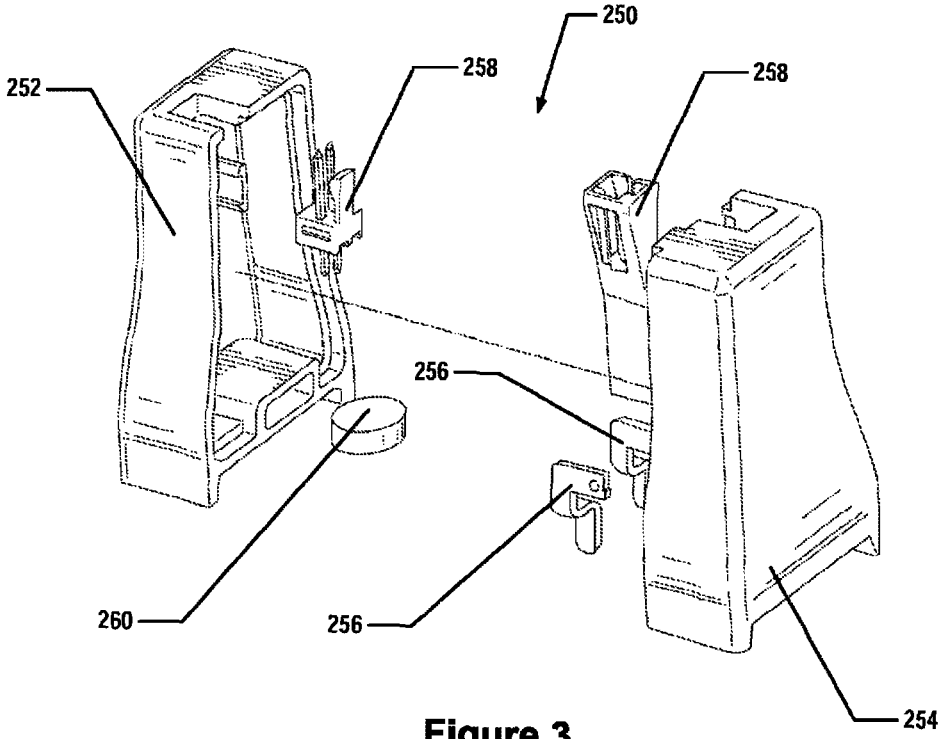
FIG. 3 shows an exploded perspective view of a power connector assembly from the track and connector assembly illustrated in FIG. 1.

As illustrated in one embodiment in FIGS. 1 through 3, an exemplary low power voltage system 200 is shown. In this example, the low voltage power system 200 is an exemplary lighting system. Those of skill in the art will recognize that any low voltage power system may be utilized without departing from these embodiments. The exemplary lighting system 200 may also be a track and connector assembly 200 for use with a retail merchandise display system. The track and connector assembly 200 may include a track 210 and a power connector assembly 250. FIG. 1 illustrates a perspective view of the track and connector assembly 200. FIG. 2 illustrates an exploded perspective view of the track and connector assembly 200 to include both the track 210 and the power connector assembly 250. FIG. 3 illustrates an exploded perspective view of the power connector assembly 250. Generally, the power connector assembly 250 connects to the track 210 both through a magnetic connection and a power connection. The power connector assembly 250 may connect to the track 210 on any part of the track 210.

The track 210 may include a first end assembly 212 and a second end assembly 214. The first end assembly 212 may be non-powered. The second end assembly 214 may include a powered top portion 216, a powered bottom portion 218, and one or more track power contacts 220. Generally, the powered portion (both top 216 and bottom 218) may provide a power source to the track 210 through the one or more track power contacts 220. The track 210 may include one or more bus bars 224 for the power connection and a metal plate 226 for the magnetic connection. The bus bars 224 may be conductive plates or other surfaces and materials that allow the distribution of power. The metal plate 226 may be any ferrous plate or other surfaces and materials for magnetic connections. Those of skill in the art will recognize that any material, shape, form, or type of conductive material may be utilized for the bus bars 224. Additionally, those of skill in the art will recognize that any material, shape, form, or type of ferrous material may be utilized for the metal plates 226, such as brass. The track 210 may also include a track mounting bracket 222. The track mounting bracket 222 may be utilized to mount to the merchandise display system, thereby allowing the track and connector assembly 200 to attach to the merchandise display system at any preferred location. Those of skill in the art will recognize that the merchandise display system may include multiple tracks 210 and multiple power connector assemblies 250 without departing from this invention.

The power connector 250 may include a housing which may include a first or left housing 252 and a second or right housing 254. Within the left housing 252 and the right housing 254 may include one or more power connector contacts 256. The power connector contacts 256 may be configured and located in line with the powered bus bars 224 on the track 210. One or more power connector jacks 258 may be electronically connected to the power connector contacts 256. The power connector jacks 258 may then provide power to a low voltage power device. The low voltage power device may include various lighting systems, such as individual LEDs or other such similar low voltage power assemblies for the merchandise display system.

Additionally, the power connector 250 may include a magnetic source 260 or mating device. The magnetic source may be a magnetic coil, magnet, or induction coil. Other magnetic or mating devices may be utilized without departing from this invention. The magnetic source 260 may be configured and located in line with the metal plate 226 on the track 210. The magnetic source 260 allows the power connector 250 and any low voltage power supply assemblies connected to the power connector 250 the ability to be moved along the entire length of the track 210. For example, individual LEDs may utilized and moved along the entire length of the track 210.

As illustrated in another embodiment in FIGS. 4 through 7, another exemplary low voltage power supply system 300 is shown. In this embodiment, a lighting system 300 is utilized as the low voltage power supply system, however other low voltage power supply systems may be utilized without departing from these embodiments. For example, the exemplary lighting system 300 may also be a track and connector assembly 300 for use with a retail merchandise display system.

Figure 4:
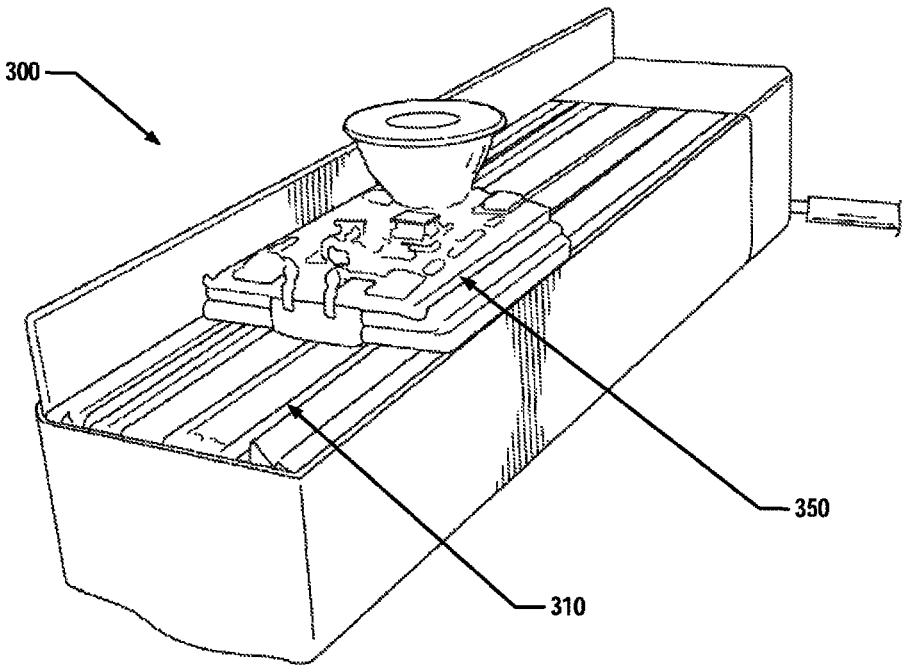
FIG. 4 shows a perspective view of another exemplary lighting assembly that includes a track and connector assembly.
Figure 5:
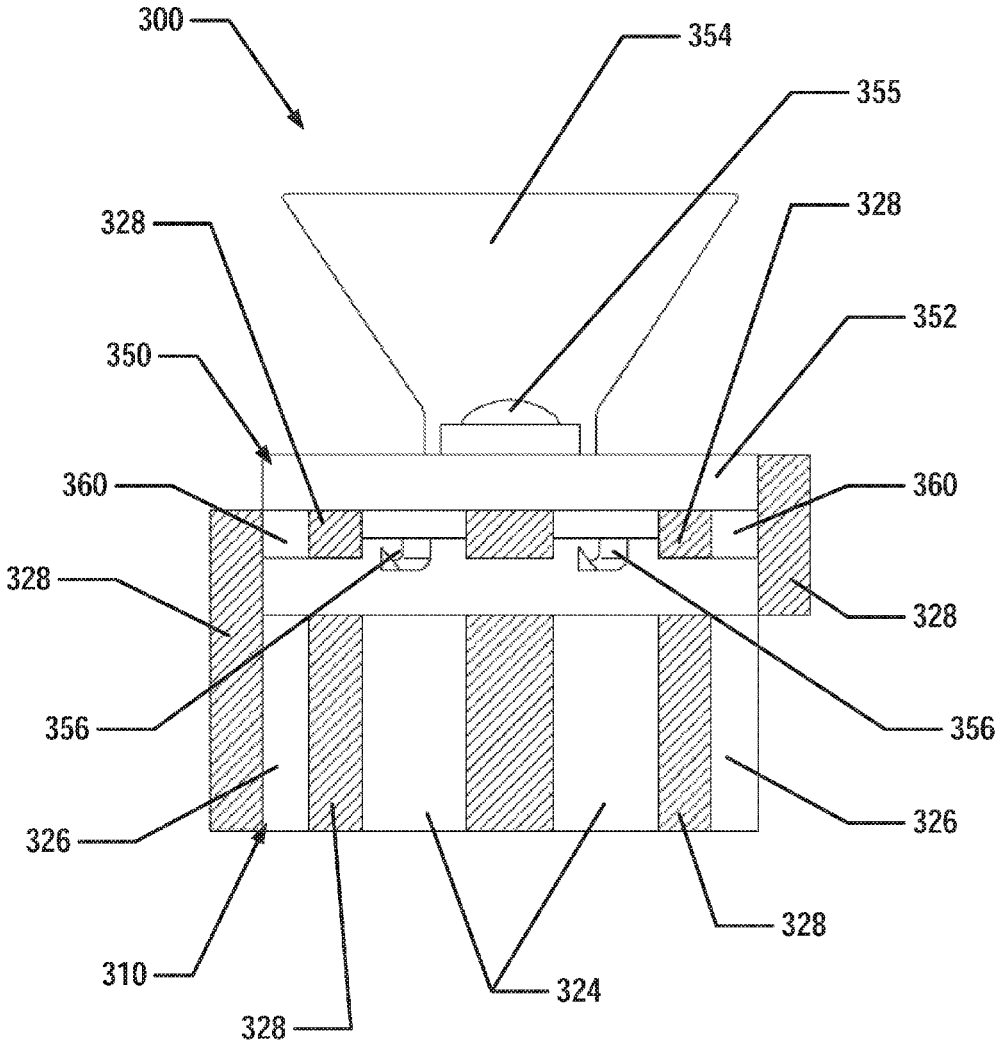
FIG. 5 shows a cross-section view of the track and connector assembly from FIG. 4.
Figure 6:
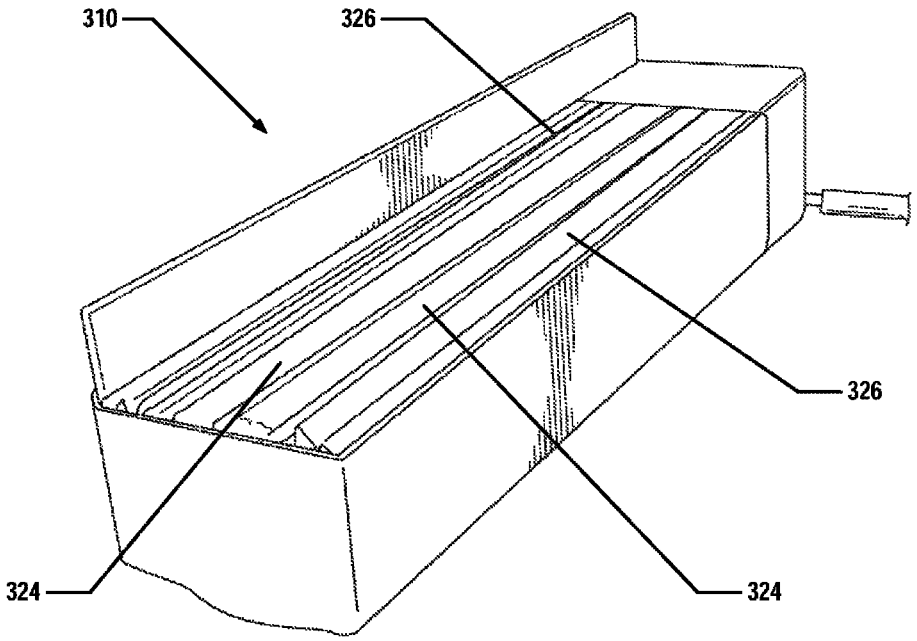
FIG. 6 shows a perspective view of a track from the track and connector assembly illustrated in FIG. 4.
Figure 7:
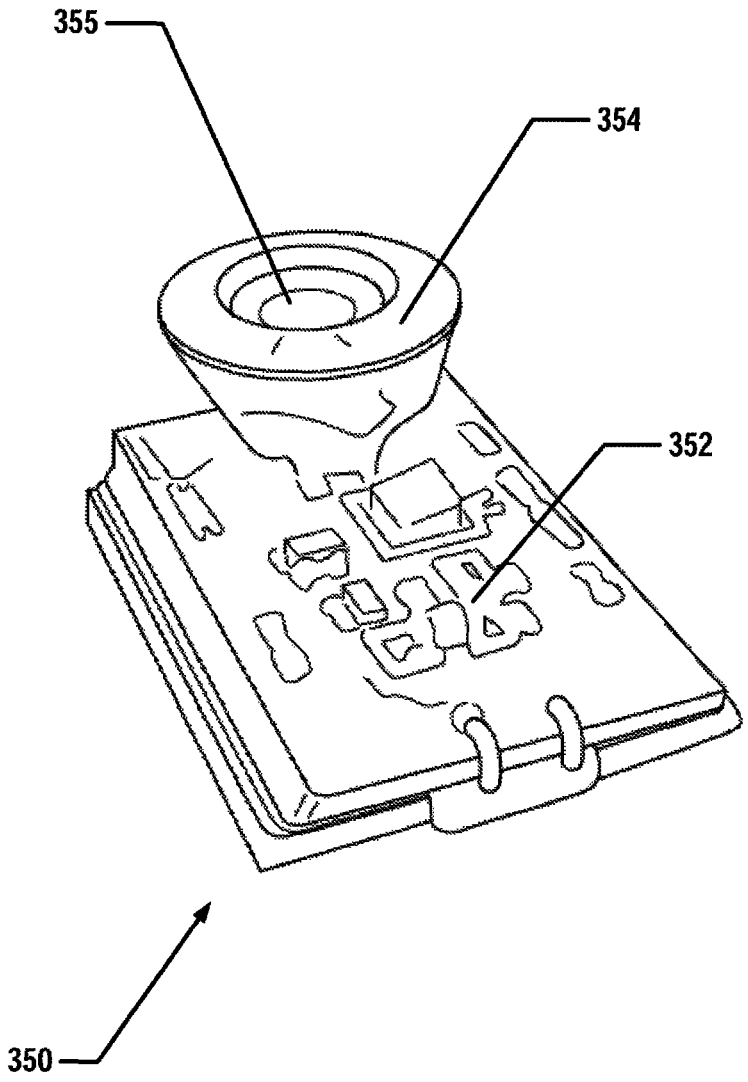
FIG. 7 illustrates a perspective view of a power connector assembly from the track and connector assembly illustrated in FIG. 4.

The track and connector assembly 300 may include a track 310 and a power connector 350. FIG. 4 illustrates a perspective view of the track and connector assembly 300. FIG. 5 illustrates a cross-section view of the track and connector assembly 300 to include both the track 310 and the power connector assembly 350. FIG. 6 illustrates a perspective view of the track 310. FIG. 7 illustrates a perspective view of the power connector assembly 350. Generally, the power connector assembly 350 connects to the track 310 both through a magnetic connection and a power connection. The power connector assembly 350 may connect to the track 310 along any portion of the track 310.

Figure 12A:
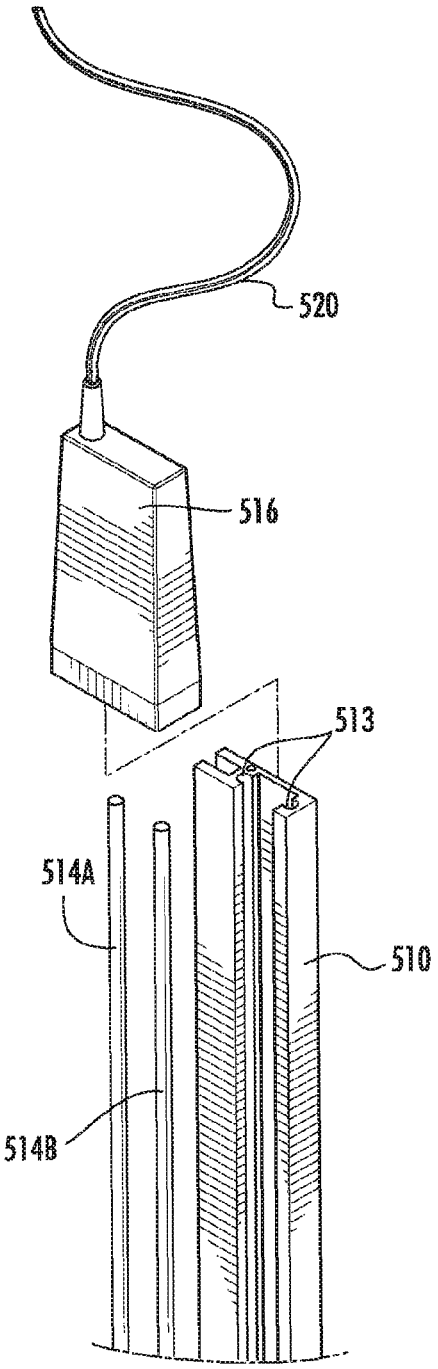
FIGS. 12A and 12B illustrate close-up views of the track for the low power voltage system illustrated in FIG. 10.
Figure 12B:
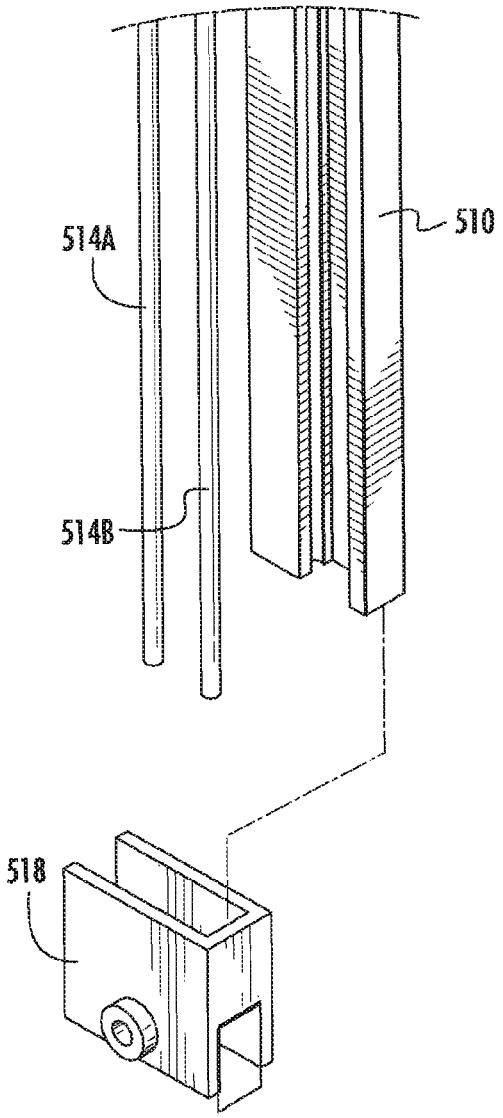
Figure 13:
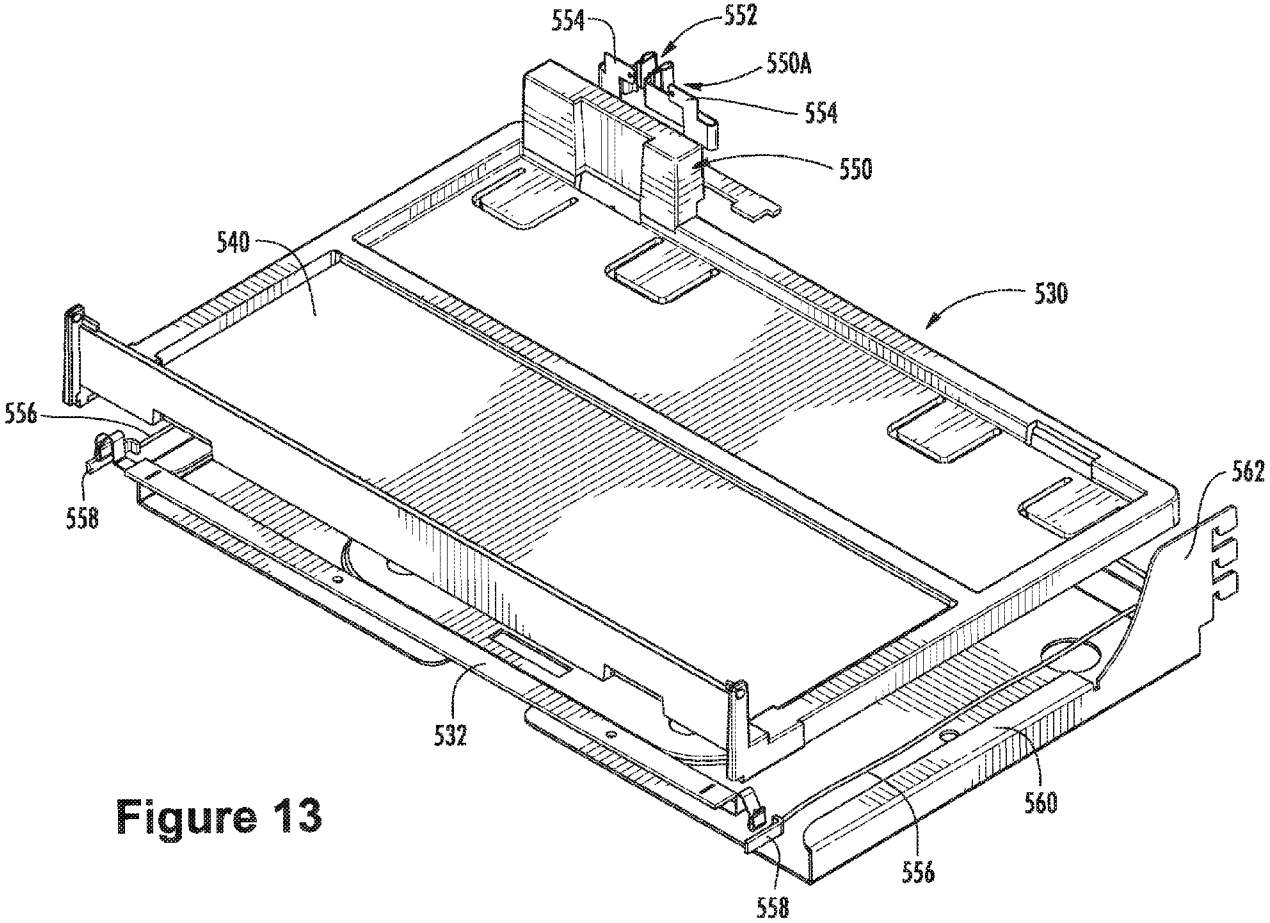
FIG. 13 illustrates an exploded view of the low power voltage system illustrated in FIG. 10.

The track 310 may include one or more conductive plates 324 and one or more ferrous plates 326. As illustrated in FIG. 12, a plurality of insulative materials 328 may be located between each of the ferrous plates 326 and the conductive plates 324. Those of skill in the art will recognize that any material, shape, form, or type of ferrous material may be utilized for the ferrous plates 324. Additionally, those of skill in the art will recognize that any material, shape, form, or type of conductive material may be utilized for the conductive plates 326, such as brass. The track 310 may also include a track mounting bracket (not shown in this embodiment). The track mounting bracket may mount to the merchandise display system, thereby allowing the track and connector assembly 300 to attach to the merchandise display system at any preferred location. In another aspect, the track may be a freestanding track without the need for a track mounting bracket. Those of skill in the art will recognize that a merchandise display system may include multiple tracks 310 and multiple power connector assemblies 350 and low voltage power supply systems without departing from this invention.

As illustrated in FIGS. 4, 5, and 6, the power connector 350 may include a printed circuit board 352 which houses the electronics for the power connector 350. In this given embodiment, a lighting assembly 354 that includes one or more LEDs 355 and/or other light sources known and used in the art may be electronically connected to the printed circuit board 352. Other low voltage power supply devices may be utilized and electronically connected to the printed circuit board 352 without departing from this invention. Additionally, the power connector 350 may include one or more power connector contacts 356. The power connector contacts 356 may be configured and located in line with the conductive plates 324 on the track 310. The power connector contacts 356 may be defined by spring contacts or any other type of power contacts known and used in the art. The power contacts 356 may then provide power to the lighting assembly 354, such as individual LEDs or other such similar lighting assemblies for the merchandise display system.

Additionally, the power connector 350 may include a magnetic source 260 or mating device. The magnetic source may be a magnetic coil, magnet, or induction coil. Other magnetic or mating devices may be utilized without departing from this invention. The magnetic source 360 may be configured and located in line with the ferrous plates 326 on the track 310. The magnetic source 360 allows the power connector 350 and any lighting assemblies 354 (or low voltage power connectors) to be connected to the power connector 350 with the ability to be moved along the entire length of the track 310.

These embodiments illustrated in FIGS. 1 through 7 solve the problem with providing power to many devices while trying to create good wire management, and also creating a dynamic or flexible system that allows for device re-location, addition of devices, and removal of devices for the power/signal system. Existing solutions include cable raceways with multiple connection points (outlet strip approach)

or powered track systems (track lighting approach). However these traditional approaches fall short in several ways. Although many conductors for power and signal combinations can be used, the "outlet strip approach" lacks flexibility and expandability for adding or relocating devices. Traditional powered track systems lack easy ways to incorporate many power and signal conductors. Additionally for each conductor added to the traditional power track systems the connector required to access those conductors grows significantly in complexity and size.

The purpose of these embodiments illustrated in FIGS. 1 through 7 is to provide a "break away" connection. Another purpose of these embodiments illustrated in FIGS. 1 through 7 is to provide an easy to use power and signal distribution track system. Track lighting is a good example of a powered track system intended for distributing power to many devices, however current track lighting systems do not use magnetic attachment methods and are not intended for distributing more than power for connected devices. These embodiments are intended to distribute both power while allowing the easy movement and placement of connected devices such as lighting systems for the retail merchandise display systems.

Examples of retail uses for this embodiment are undershelf or display-case lighting that may require spot lights for product specials. Spot light modules such as the proof of concept prototype could be used to add lighting in a dynamic, modular, and reconfigurable way. Examples of non-retail applications might include systems which use sensor modules that communicate via additional conductors in the configuration or assembly. This type of application would allow for easy customization of the sensor system.

If additional voltages are added to the configuration of products, additional configurations of products that require different voltages could be connected on the same distribution track such that the devices contacts make contact only with the conductors required. In a given aspect of this invention, there may two bus bars and/or conductive plates. In another aspect of this invention, there may be four bus bars and/or conductive plates in order to handle various additional voltages.

Other devices using this distribution track may separate the magnetic connector from the device itself by using a corded magnetic connector. This allows for many types of devices (especially larger devices) to make use of the distribution track. One example might be embedded hardware devices which use the distribution track as a means for getting power and for intercommunications between embedded devices utilizing additional signal conductors.

Another advantage of this embodiment is that the distribution track implementations may incorporate many conductors for power and/or signal and may only grow in size as conductors are added. The additional conductors for power and/or signal may not increase the complexity because the access of one conductor does not interfere with the other conductors as it does in the traditional powered track approach. This characteristic allows the design technique to be scalable for many applications.

LED lighting systems may be utilized with these embodiments as a low voltage power supply with magnetic connections, and specifically LED lighting systems utilized with a retail merchandise display system. LED lighting systems as disclosed in U.S. application Ser. No. 13/162,076, filed Jun. 16, 2011 and U.S. application Ser. No. 12/955,198, filed Nov. 29, 2010 wherein each of the above-identified U.S. applications are herein incorporated by reference in their entirety.

Figure 8:
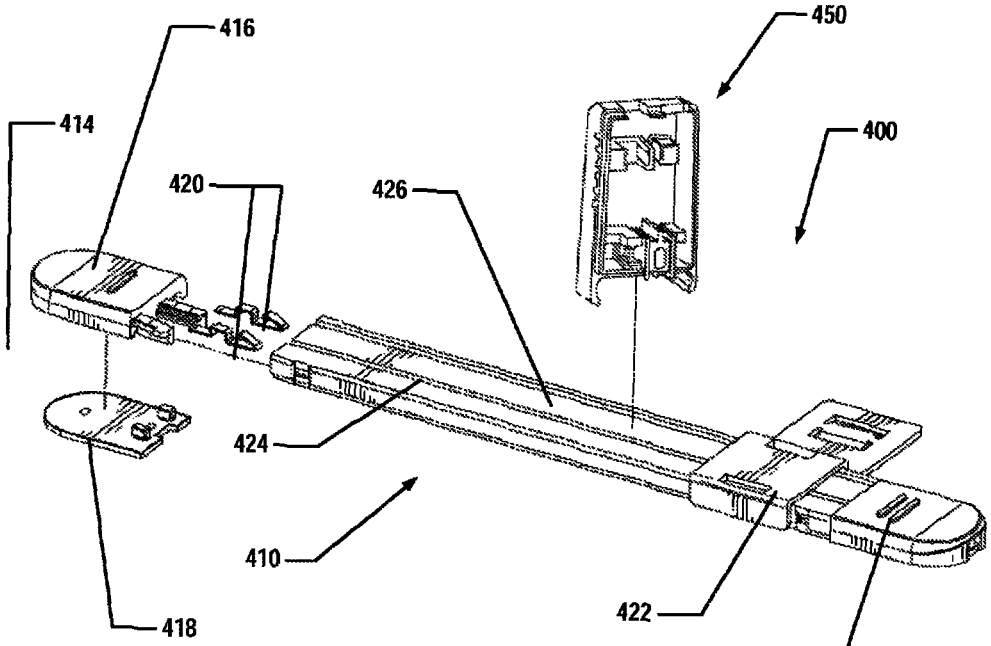
FIG. 8 illustrates a perspective view of an exemplary power assembly that includes a track and connector assembly.
Figure 9A:
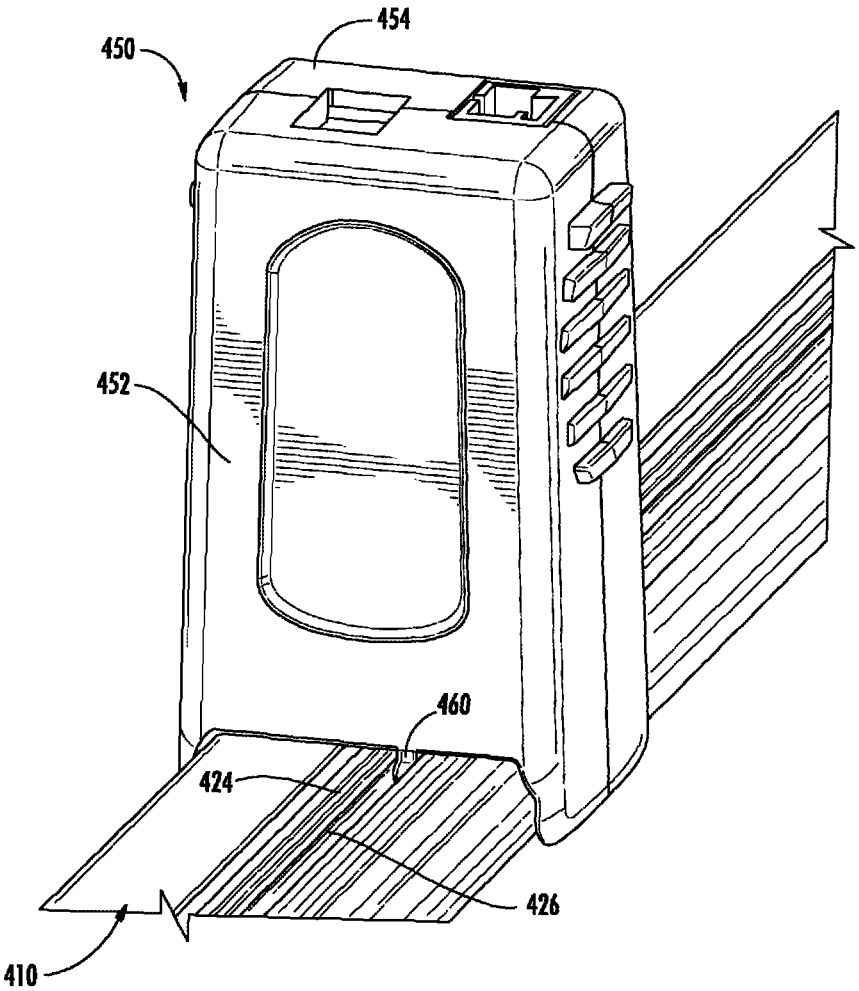
FIG. 9A illustrates a close-up perspective view of the power connector assembly from the track and connector assembly illustrated in FIG. 8.
Figure 9B:
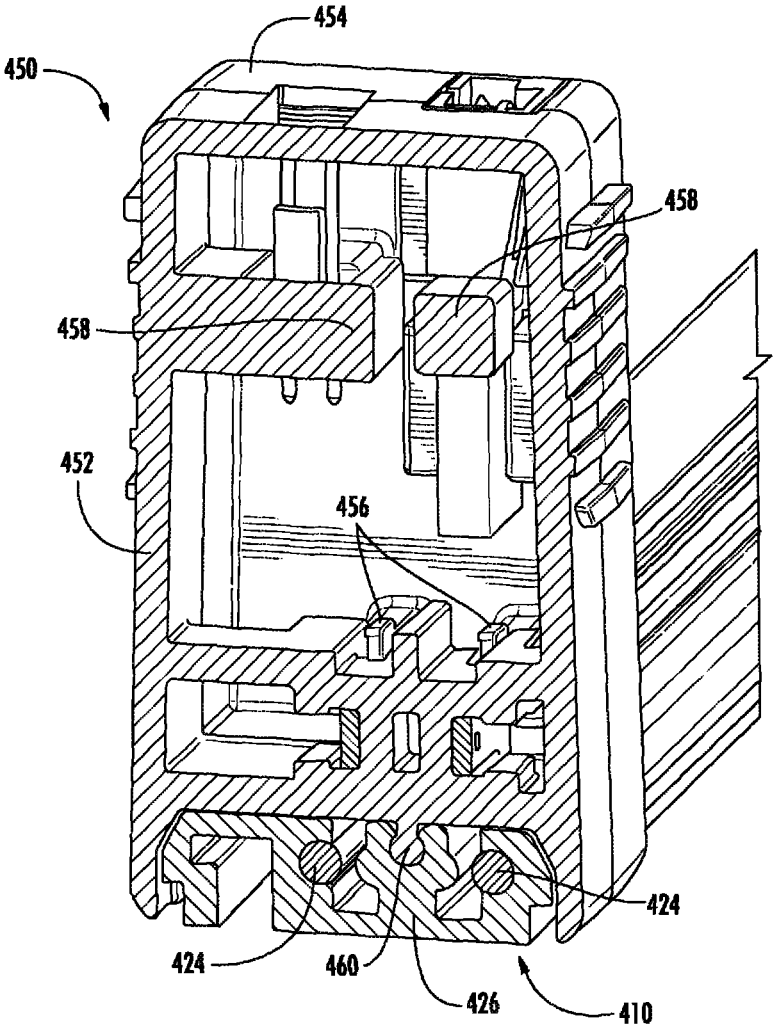
FIG. 9B illustrates a cross-section perspective view of the power connector assembly from the track and connector assembly illustrated in FIG. 8.
Figure 9C:
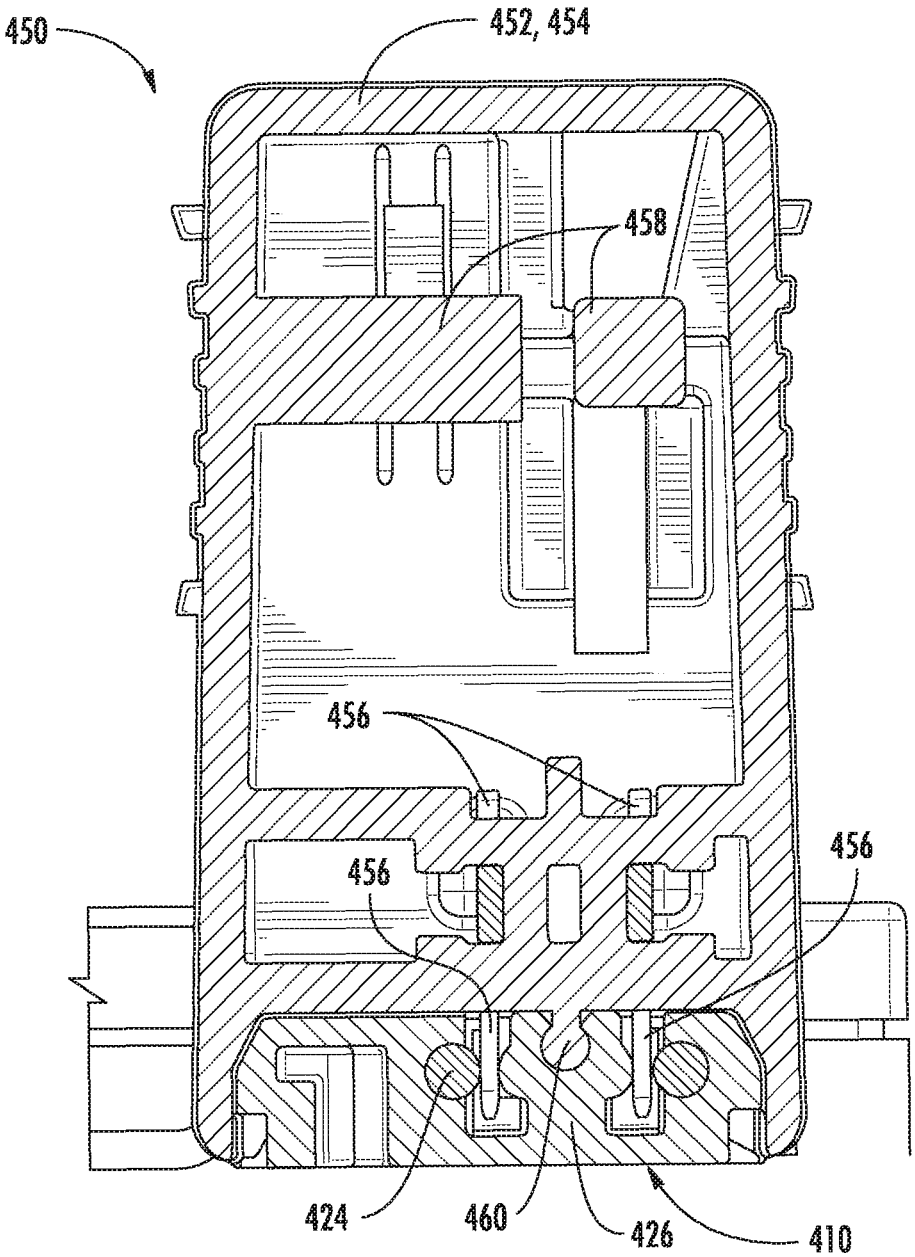
FIG. 9C illustrates a cross-section view of the power connector assembly from the track and connector assembly illustrated in FIG. 8.
Figure 10:
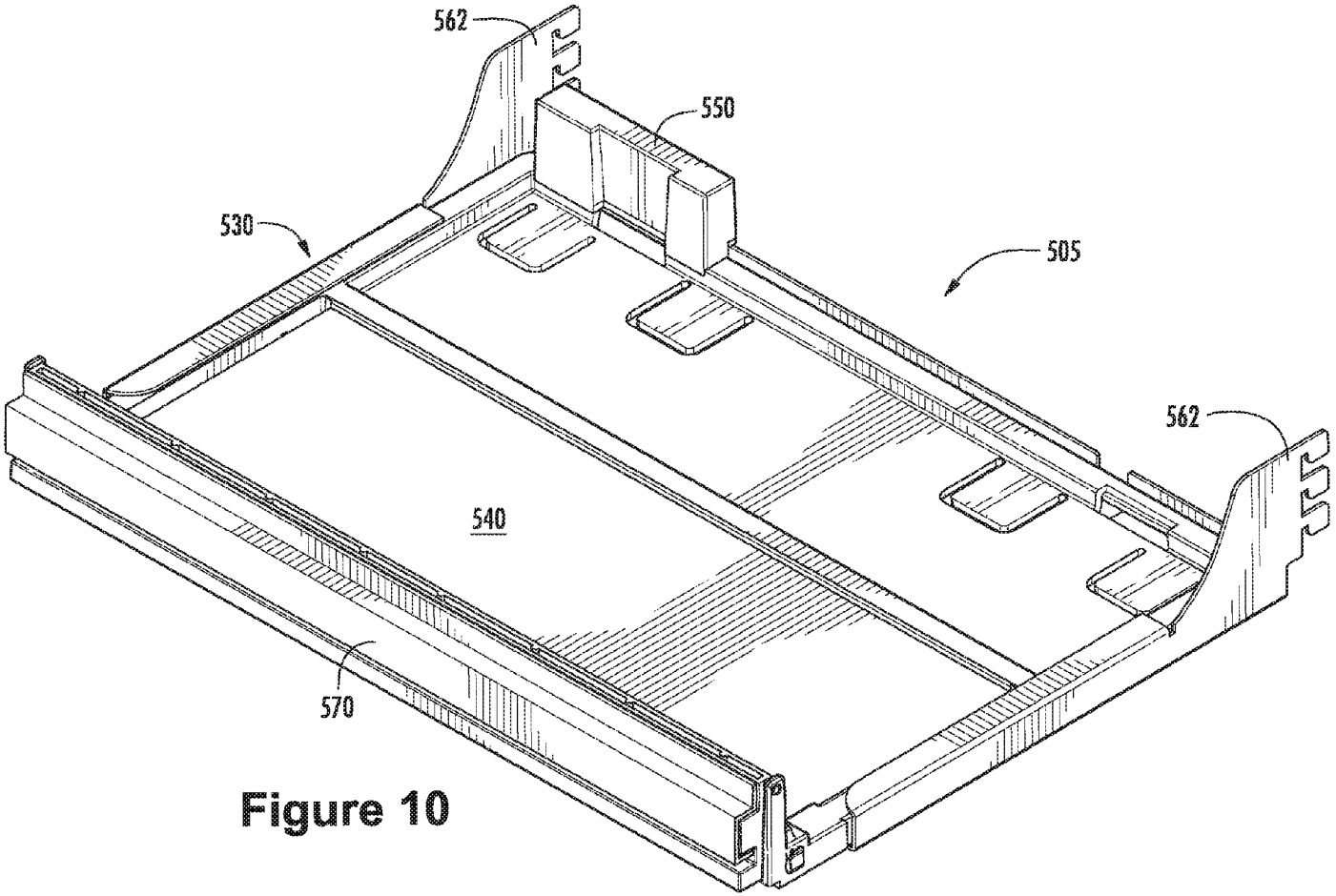
FIG. 10 illustrates a perspective view of an exemplary low power voltage system used with a merchandise display system.
Figure 11A:
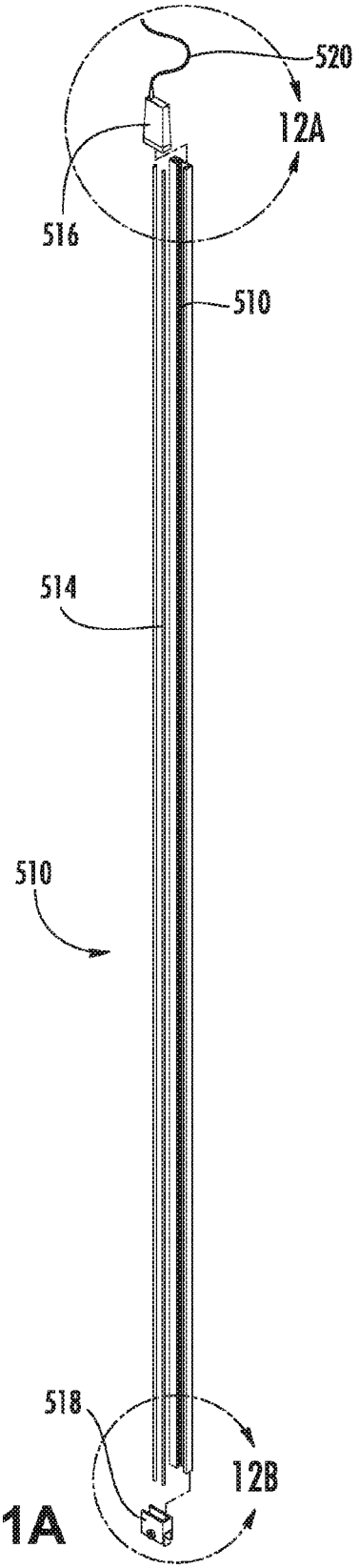
FIGS. 11A and 11B illustrate views of a track for the low power voltage system illustrated in FIG. 10.
Figure 11B:
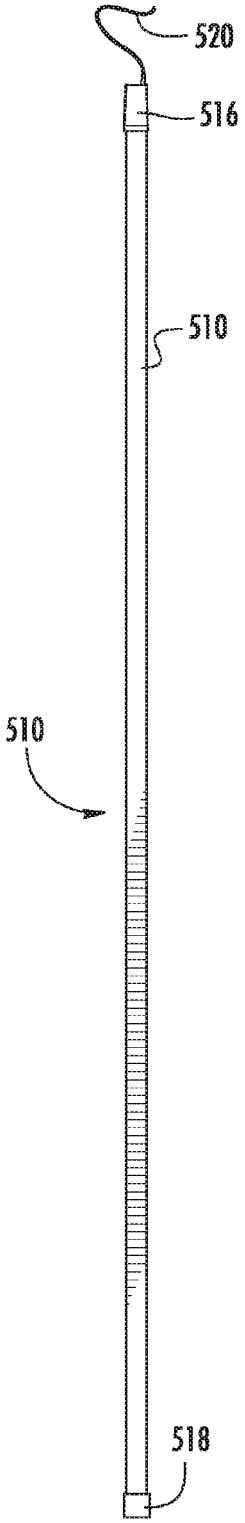

In another aspect of this invention, as illustrated in FIGS. 8 through 9C, a power assembly may utilize a mechanical connection instead of the magnetic connection as described above. The power assembly may be a low voltage power assembly in accordance with aspects of this invention. Additionally, high voltage power assemblies may utilize the mechanical connections disclosed without departing from this disclosure. The mechanical connection may be a snap connector or other kinds of mechanical connections known and used in the art. As was described above, the power assembly may comprise a track that includes one or more conductive plates and a mechanical connector, wherein the track is powered from a power source; and a power connector assembly that connects to the track, wherein the one or more conductive plates connect to the power assembly providing a power connection, and further wherein the mechanical connector connects to the power assembly providing a secure connection. This power connector assembly may be configured to provide power through the track to a power device.

Generally, below, a low voltage power system will be described. The low voltage power system may be utilized as a distribution track with a mechanical power connector connected both mechanically and for power to the distribution track. The exemplary low power voltage system may include a configuration or assembly of conductive materials arranged in such a way as to provide a method for power and/or signal distribution to a mating device. The mating device may include a set of mechanically connected low voltage power modules. One example low voltage power module may be a mechanically connected LED module. The mating device may include various mechanically connected configurations, such as snap fit connections, bolted assemblies, threaded metal inserts, hook and loop type fasteners, molded in threads, push-on/turn-on fasteners, rivets, press-fits, or similar mechanical-type connection devices. The conductive materials may be for example spring contacts or any other similar conductive contact material. The electronics may utilize the distributed power and/or signals.

As illustrated in one embodiment in FIGS. 8 through 9C, an exemplary low power voltage system 400 is shown. In this example, the low voltage power system 400 is an exemplary lighting system. Those of skill in the art will recognize that any low voltage device or power system may be utilized without departing from these embodiments. The exemplary lighting system 400 may also be a track and connector assembly 400 for use with a retail merchandise display system. The track and connector assembly 400 may include a track 410 and a power connector assembly 450. FIG. 8 illustrates a perspective view of the track and connector assembly 400. FIG. 9A illustrates a close-up perspective view of the power connector assembly 450. FIG. 9B illustrates a cross-section perspective view of the power connector assembly 450. FIG. 9C illustrates a cross-section view of the power connector assembly 450. Generally, the power connector assembly 450 connects to the track 410 both through a mechanical connection and a power connection. The power connector assembly 450 may connect to the track 410 on any part of the track 410.

The track 410 may include a first end assembly 412 and a second end assembly 414. The first end assembly 412 may be non-powered. The second end assembly 414 may include a powered top portion 416, a powered bottom portion 418, and one or more track power contacts 420. Generally, the powered portion (both top 416 and bottom 418) may provide a power source to the track 410 through the one or more track power contacts 420. The track 410 may include one or more bus bars 424 for the power connection and a mechanical connection track or surface 426 for the mechanical connection. The bus bars 424 may be conductive plates or other surfaces and materials that allow the distribution of power. The mechanical connection track or surface 426 may be any plate or other surfaces and materials for mechanical connections as will be explained in more detail below. Those of skill in the art will recognize that any material, shape, form, or type of conductive material may be utilized for the bus bars 424. Additionally, those of skill in the art will recognize that any material, shape, form, or type of material may be utilized for the mechanical connection track or surface 426. The track 410 may also include a track mounting bracket 422. The track mounting bracket 422 may be utilized to mount to the merchandise display system, thereby allowing the track and connector assembly 400 to attach to the merchandise display system at any preferred location. Those of skill in the art will recognize that the merchandise display system may include multiple tracks 410 and multiple power connector assemblies 450 without departing from this invention.

The power connector 450 may include a housing which may include a first or left housing 452 and a second or right housing 454. Within the left housing 452 and the right housing 454 may include one or more power connector contacts 456. The power connector contacts 456 may be configured and located in line with the powered bus bars 424 on the track 410. One or more power connector jacks 458 may be electronically connected to the power connector contacts 456. The power connector jacks 458 may then provide power to a low voltage power device. The low voltage power device may include various lighting systems, such as individual LEDs, other lighting sources, powered track devices, or other such similar low voltage power assemblies for a track system.

Additionally, the power connector 450 may include a mechanical connector 460 or mating device. The mechanical connector 460 may cooperate and engage the mechanical connection track 426 to connect the power connector 450 to the track 410. The mechanical connector 460 and the mechanical connection track 426 may be one of various different mechanical connector assemblies without departing from this invention. For example, as shown in FIGS. 9A through 9C, the mechanical connector 460 and the mechanical connection track 426 and may be a snap fit connector, and more specifically a cylindrical type snap fit connector. In other examples of this embodiment, the mechanical connector 460 and the mechanical connection track 426 and may be a snap fit connector, such as a cantilever beam snap fit connection or a spherical type snap fit connection. Other types of mechanical connections known and used in the art may be utilized between the mechanical connector 460 and the mechanical connection track 426, such as bolted assemblies, threaded metal inserts, hook and loop type fasteners, molded in threads, push-on/turn-on fasteners, rivets, press-fits, or similar mechanical-type connection devices. The mechanical connector 460 may be configured and located in-line with and the mechanical connection track 426 on the track 410 such that the mechanical connector 460 engages and/or cooperates with the mechanical connection track 426 to connect the power connector 450 to the track 410. The mechanical connector 460 allows the power connector 450 and any low voltage power supply assemblies connected to the power connector 450 the ability to be moved along the entire length of the track 410. For example, individual LEDs, other lighting sources, or powered track devices may utilized with the power connector 450 and be moved along the entire length of the track 410.

FIGS. 10 through 16B illustrate another aspect of this invention. Specifically, FIGS. 10 through 16B illustrate a low voltage power system used with a merchandising system. Generally, as described above, the low voltage power system may include a distribution track with a tray connected either mechanically or magnetically and for power to the distribution track. In one exemplary embodiment, the tray may include a power connector, with one or more mechanical or magnetic connector systems with a lighting assembly or lighting bar, such as LEDs or other types of lights. The exemplary low voltage power system may include a configuration or assembly of ferrous material, conductive material, and nonconductive materials arranged in such a way as to provide a method for power and/or signal distribution to a power connector. The power connector may include a set of mechanically connected low voltage power modules. One example low voltage power module may be a tray with a mechanically connected power connector. The mechanical power connector may include various mechanically connected configurations, such as snap fit connections, bolted assemblies, threaded metal inserts, hook and loop type fasteners, molded in threads, push-on/turn-on fasteners, rivets, press-fits, or similar mechanical-type connection devices. The power connector may also include or alternatively include a set of magnetic connected power connectors. The magnetic power connector may include various magnetic configurations and materials, such as magnets or magnetic coils, conductive materials, nonconductive materials, and electronics. The conductive materials may be for example spring contacts. The electronics may utilize the distributed power and/or signals.

As illustrated in one embodiment in FIGS. 10 through 16B, an exemplary retail merchandise display system is shown. The merchandise display system includes a track and connector assembly 505 which includes a low power voltage system. In this example, the track and connector assembly 505 may include an exemplary lighting system, such as LEDs. Those of skill in the art will recognize that any low voltage power system may be utilized without departing from these embodiments. The track and connector assembly may include a track 510 and a tray assembly 530. The tray assembly 530 may include a power connector 550. Generally, the power connector 550 connects to the track 510 both through a mechanical or magnetic connection and a power connection. The power connector 550 may connect to the track 510 on any part of the track 510.

As illustrated in FIGS. 11A through 12B, the track 510 may include a housing 512 and one or more power contacts 514. The track may also include a first end 516 and a second end 518. The first end 516 may include a power wire 520 which can be connected to a power source to provide power the power contacts 514. The housing 512 may be configured to extend vertically along a retail merchandise display system. The housing may be made of a plastic extrusion. The one or more power contacts 514 may include contact wires 514A 514B installed or set into the housing 512. As illustrated in FIG. 12A, the housing 512 may include curved slots 513 to hold the contact wires 514A 514B.

The housing 512 may be non-powered. Generally, the power contacts 514 may provide a power source to the track 510 through the one or more track contact wires 514A 514B. The power contacts 514 may be conductive wires, rods, or plates or other surfaces and materials that allow the distribution of power. The power contacts 514 may also include any ferrous plate or other surfaces and materials for magnetic connections. Those of skill in the art will recognize that any material, shape, form, or type of conductive material may be utilized for the power contacts 514. Additionally, those of skill in the art will recognize that any material, shape, form, or type of ferrous material may be utilized for the power contacts 514, such as brass.

The track 510 may also include a track mounting bracket (not shown). The track mounting bracket may be utilized to mount the track 510 to the merchandise display system, thereby allowing the track and connector assembly to attach to the merchandise display system at any preferred location. Those of skill in the art will recognize that the merchandise display system may include multiple tracks 510 and multiple power connectors 550 without departing from this invention.

FIGS. 13 through 16B illustrate the tray assembly 530. The tray assembly 530 includes a tray 540. The tray assembly 530 may also include a pan 560. The pan 560 may be an existing metal pan already attached to and connected to the merchandise display. The tray 540 may be sized and shaped to slide into and or fit with the pan 560. Generally, the pan 560 includes the structure to support and hold the tray assembly 530 as well as any required products or merchandise. The pan 560 may include arms 562 that attach or connect to the merchandise display system.

Figure 14:
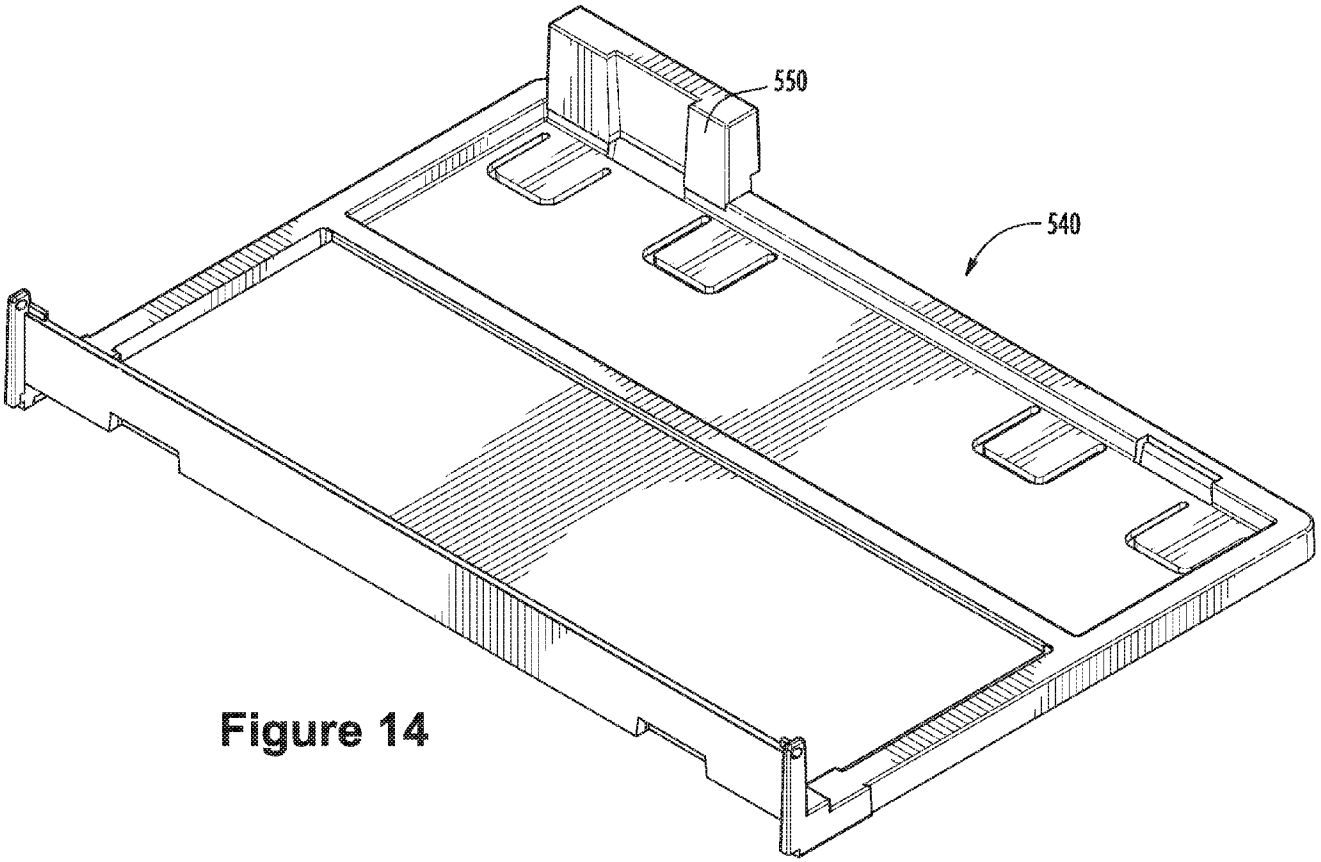
FIG. 14 illustrates a perspective view of a tray assembly for the low power voltage system illustrated in FIG. 10.

As illustrated in FIG. 14, the tray 540 includes a front portion, a rear portion, and two sides. Any size or shape of the tray 540 may be utilized without departing from this invention. The tray 540 may be rectangular, square, or other shapes without departing from this invention. The tray 540 may be configured to slide into the pan 560 and held by the pan 560 in the merchandise display system. In other embodiments without departing from this invention, the tray 540 may provide the supports necessary for attaching to or connecting to the merchandise display system, without the use of a pan 560.

Figure 15A:
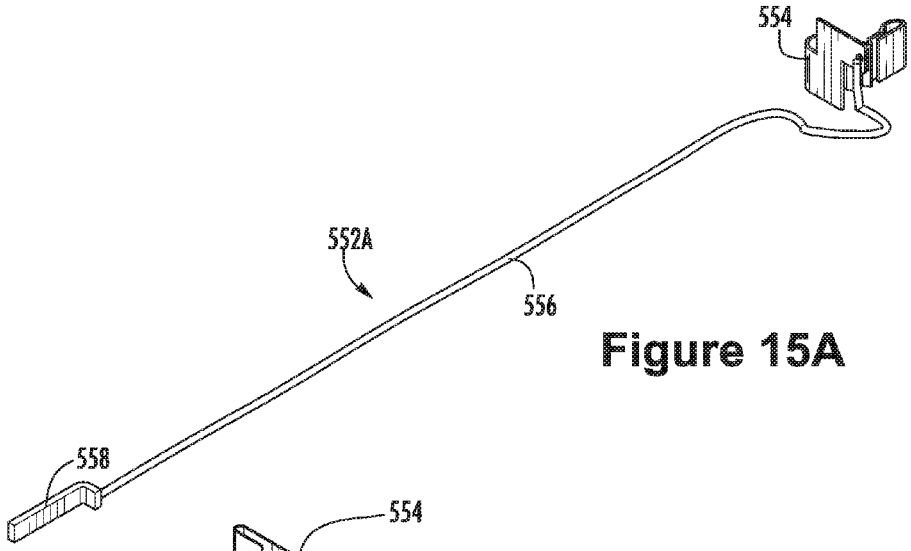
FIGS. 15A and 15B illustrate perspective views of the power contact assembly for the low power voltage system illustrated in FIG. 10.
Figure 15B:
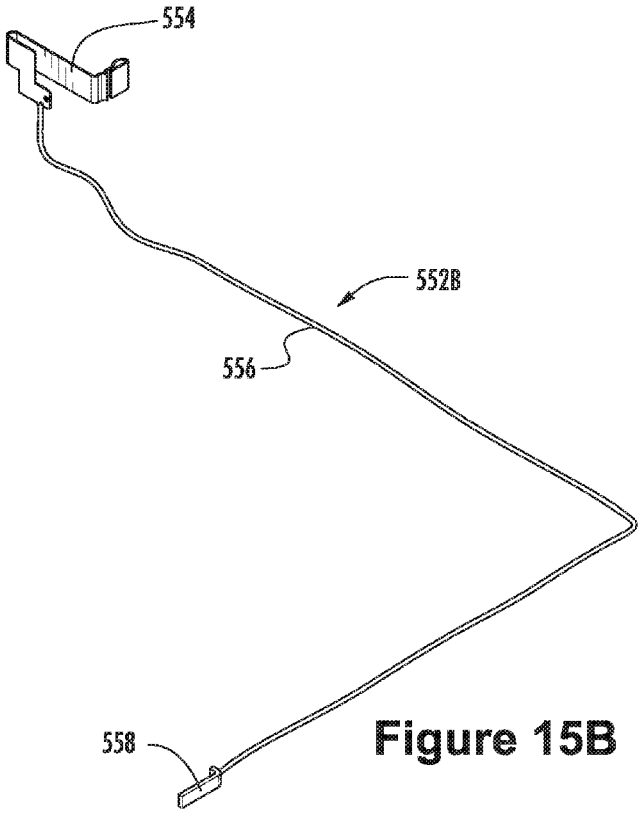

As shown in these illustrative embodiments, the tray assembly 530 includes a power connector 550. The power connector may include one or more contact assemblies 552. The contact assembly may include a contact 554, a wire harness 556, and a power jack 558. The contact 554 may be located near the rear portion of the tray 540. The power jack 558 may be located near or at the front portion of the tray 540 and near or at a lighting source or LED printed circuit board assembly. The wire harness 556 extends between the contact 554 at the rear portion of the tray 540 to the power jack 558 at the LED printed circuit board assembly. As shown in FIGS. 15A and 15B, the contact assembly 552 may include a right hand contact assembly 552A and a left hand contact assembly 552B.

Additionally, the power connector 550 may include a mechanical connector 550A or mating device or the power connector 550 may work as a mechanical connector 550A. The mechanical connector 550A may cooperate and engage the track 510 to connect the power connector 550 to the track 510. The mechanical connector 550A and the track 510 may be one of various different mechanical connector assemblies without departing from this invention. For example, the mechanical connector 550A and the track 510 and may be a snap fit connector, and more specifically a clip-type snap fit connector. In other examples of this embodiment, the mechanical connector 550A and the track 510 may be a cylindrical type snap fit connector. In other examples of this embodiment, the mechanical connector 550A and the track 510 may be a snap fit connector, such as a cantilever beam snap fit connection or a spherical type snap fit connection. Other types of mechanical connections known and used in the art may be utilized between the mechanical connector 550A and the track 510, such as bolted assemblies, threaded metal inserts, hook and loop type fasteners, molded in threads, push-on/turn-on fasteners, rivets, press-fits, or similar mechanical-type connection devices. The mechanical connector 550A may be configured and located in-line with and on the track 510 such that the mechanical connector 550A engages and/or cooperates with the track 510 to connect the power connector 550A to the track 510. The mechanical connector 550A allows the power connector 550 and any low voltage power supply assemblies connected to the power connector 550 the ability to be moved along the entire length of the track 510. For example, individual LEDs, other lighting sources, or powered track devices may utilized with the power connector 550 and be moved along the entire length of the track 510.

Figure 16A:
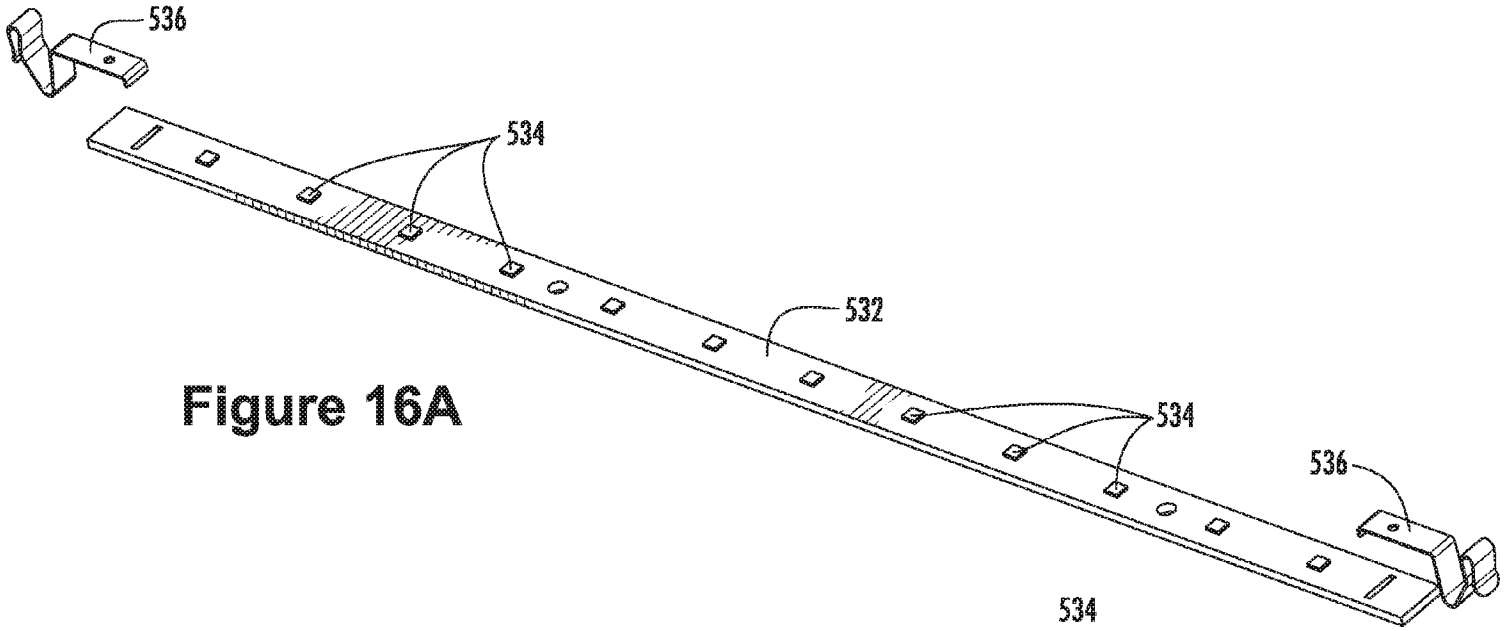
FIGS. 16A and 16B illustrate views of the LED printed circuit board assembly for the low power voltage system illustrated in FIG. 10.
Figure 16B:
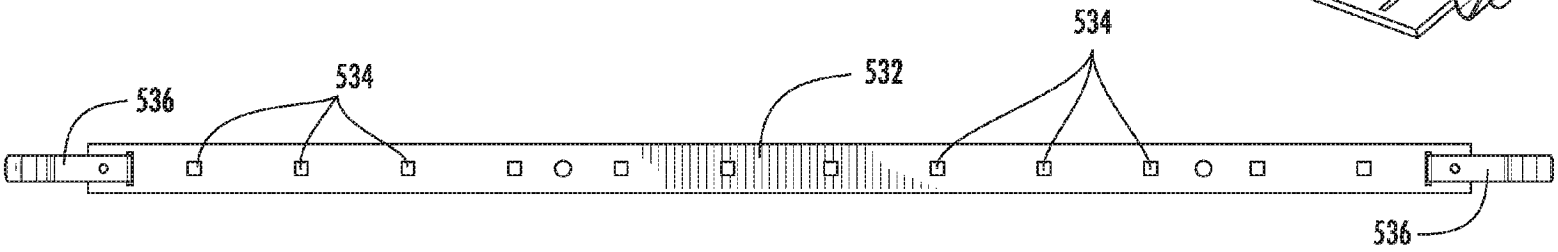

The tray assembly 530 may also include a lighting source. As illustrated in FIGS. 16A and 16B the tray assembly 530 includes a LED printed circuit board assembly lighting source 532. The LED printed circuit board assembly 532 may be located at or near the front portion of the tray 540. The LED printed circuit board assembly 532 may extend across the entire front portion of the tray 540. In other embodiments of the invention, the LED printed circuit board assembly 532 may extend across a portion of the front portion of the tray 540. The LED printed circuit board assembly 532 may be located at various other locations of the merchandise display without departing from this invention.

The LED printed circuit board assembly 532 may include various LED light sources 534 to illuminate the merchandise display system. Additionally, the LED printed circuit board assembly 532 may include metal clips 536 or ends. The metal clips may attach or connect to the ends of the LED printed circuit board assembly 532 and the power jack 558 of the contact assembly 552. The connection from the power wire 520 to the power contacts 514 to the contact assembly 552 with the contact 554, the wire harness 556, and the power jack 558, and finally through to the metal clip 536 powers the LEDs 534 on the printed circuit board assembly 532.

As is described and detailed above, any low voltage power source may be powered by this invention, not just an LED printed circuit board assembly. For example, the connection from the power wire 520 to the power contacts 514 to the contact assembly 552 with the contact 554, the wire harness 556, and the end contact 558, and finally through to the metal clip 536 may power any other low voltage power source without departing from this invention. The low voltage power source may include various lighting systems, such as individual LEDs or other such similar low voltage power assemblies for the merchandise display system.

The tray assembly 530 may also include a flip front portion 570 that allows the description and/or labelling of products and/merchandise. The flip front portion 570 may be located towards the front portion of the tray 540. The flip front portion 570 may include a clear lens such that the light from the LEDs 534 may be illuminated through the flip front portion 570. The flip front portion 570 may also flip up and down as required to assist with the merchandise display system.

Additionally, in another aspect of this invention, a low voltage power system may be utilized as a distribution track that includes 1) one or more mechanical power connector connected both mechanically and for power to the distribution track and 2) one or more magnetic power connector connected both magnetically and for power to the distribution track. Both the mechanical power connector and the magnetic power connector may be utilized and defined as above. Both the mechanical power connector and the magnetic power connector may be utilized without departing from this invention.

The reader should understand that these specific examples are set forth merely to illustrate examples of the invention, and they should not be construed as limiting the invention. Many variations in the lighting assemblies may be made from the specific structures described above without departing from this invention.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A low voltage power assembly comprising:

a track that includes a first end and a second end opposite the first end that is powered from a low voltage power source;

a power connector assembly that includes an induction coil and electrically connects to the track to provide low voltage power through the track to a low voltage power device;

wherein the power connector assembly includes one or more power connector jacks providing a low voltage power connection to the low voltage power device;

wherein the power connector assembly can be moved along the entire length of the track while maintaining the low voltage power connection;

wherein the power connector assembly further connects to the track through a magnetic connection; and wherein the track includes one or more metal plates that connect to the power connector assembly providing the magnetic connection.

2. The low voltage power assembly of claim 1, wherein the first end of the track is a powered end and the second end of the track is a non-powered end.

3. The low voltage power assembly of claim 1, wherein the track includes one or more conductive materials that connect to the power connector assembly providing the low voltage power connection.

4. The low voltage power assembly of claim 3, wherein the one or more conductive materials form bus bars.

5. The low voltage power assembly of claim 1, wherein the one or more metal plates are made of ferrous metals.

6. The low voltage power assembly of claim 1, wherein the power connector assembly further comprises a printed circuit board that connects to the one or more power connector jacks of the power connector assembly.

7. The low voltage power assembly of claim 1, wherein the low voltage power device has a voltage of 24 volts or less.

8. A low voltage power assembly comprising:

a surface that includes one or more conductive materials adjacent to one another and a mechanical connection track adjacent the one or more conductive materials, wherein the surface is powered from a low voltage power source, and the surface provides low voltage power to a power connector assembly to provide low voltage power through the surface to a low voltage power device, wherein the power connector assembly includes one or more power connector jacks providing a low voltage power connection to the low voltage power device, and wherein the power connector assembly can be moved along the entire length of the surface while maintaining the low voltage power connection.

9. The low voltage power assembly of claim 8, wherein the power connector assembly further comprises a mechanical connector that cooperates and engages the mechanical connection track to form a mechanical connection to connect the power connector assembly to each track.

10. The low voltage power assembly of claim 9, wherein the mechanical connector and mechanical connection track form a snap-fit connection.

11. The low voltage power assembly of claim 10, wherein the snap-fit connection is a clip-type snap-fit connection.

12. The low voltage power assembly of claim 9, wherein the mechanical connector and mechanical connection track form a press-fit connection.

13. The low voltage power assembly of claim 8, wherein the low voltage power device has a voltage of 24 volts or less.

14. A low voltage power assembly comprising:

a surface having a first end and a second end opposite the first end that includes one or more conductive materials adjacent to one another extending from the first end of the surface to the second end of the surface, wherein the surface is powered from a low voltage power source;

a power connector assembly that includes an induction coil and connects to the surface to provide low voltage power through the surface to a low voltage power device;

wherein the power connector assembly includes one or more power connector jacks providing a low voltage power connection to the low voltage power device, and wherein the power connector assembly can be moved along the entire length of the surface while maintaining the low voltage power connection.

15. The low voltage power assembly of claim 14, wherein the power connector assembly further connects to the surface through a magnetic connection.

16. The low voltage power assembly of claim 15, wherein the surface includes one or more metal plates adjacent the one or more conductive materials that connect to the power connector assembly providing the magnetic connection.

17. The low voltage power assembly of claim 16, wherein the one or more metal plates are made of ferrous metals.

18. The low voltage power assembly of claim 14, wherein the low voltage power device has a voltage of 24 volts or less.

* * * * *